US007210509B2

(12) United States Patent
Rautio

(10) Patent No.: US 7,210,509 B2
(45) Date of Patent: May 1, 2007

(54) CHIPPING HEAD

(76) Inventor: Kauko Rautio, Kolmihaarantie 4, Mantyharju (FI) FI-52700

( * ) Notice: Subject to any disclaimer, the term of this patent is extended or adjusted under 35 U.S.C. 154(b) by 125 days.

(21) Appl. No.: 10/804,887

(22) Filed: Mar. 19, 2004

(65) Prior Publication Data

US 2004/0250898 A1 Dec. 16, 2004

(30) Foreign Application Priority Data

Mar. 21, 2003 (FI) ..... 20030419

(51) Int. Cl.
*B27C 1/00* (2006.01)

(52) U.S. Cl. ..... 144/118; 144/162.1; 144/220; 144/39; 144/3.1

(58) Field of Classification Search ..... 144/176, 144/118, 162.1, 218, 220, 4.9, 7.6, 3.1, 39; 407/42, 48, 47, 67, 115; 83/847, 835
See application file for complete search history.

(56) References Cited

U.S. PATENT DOCUMENTS

| | | | | |
|---|---|---|---|---|
| 88,649 | A * | 4/1869 | Machamer | 83/835 |
| 3,165,813 | A * | 1/1965 | Harvell et al. | 407/29.13 |
| 3,330,315 | A | 7/1967 | Tomlinson, II | 144/176 |
| 3,645,308 | A * | 2/1972 | Nilsson | 144/176 |
| 3,732,907 | A | 5/1973 | Nystrom et al. | 144/176 |
| 3,754,297 | A * | 8/1973 | Metz | 15/236.1 |
| 3,814,155 | A | 6/1974 | Reuter | 144/219 |
| 3,880,215 | A * | 4/1975 | Mallery | 144/39 |
| 4,184,526 | A | 1/1980 | Hanaya | 144/235 |
| 4,187,754 | A * | 2/1980 | Beaty | 83/847 |
| 4,499,934 | A | 2/1985 | Rautio | 144/176 |
| 5,782,278 | A * | 7/1998 | Larsson | 144/220 |
| 6,026,872 | A | 2/2000 | Leitinger | 144/369 |
| 6,427,568 | B1 * | 8/2002 | Gebelius et al. | 83/13 |

FOREIGN PATENT DOCUMENTS

| | | |
|---|---|---|
| DE | 19607558 | 5/1997 |
| EP | 0792728 | 9/1997 |
| WO | 8402871 | 8/1984 |
| WO | 0183175 | 8/2001 |

* cited by examiner

*Primary Examiner*—Bena Miller
(74) *Attorney, Agent, or Firm*—Baker Botts LLP

(57) ABSTRACT

A chipping head, particularly a chipping head of a chipping canter, is disclosed comprising a head body having thereon mounted multiple chipping knives that are adapted on the head body in an annular fashion spaced at a distance from each other. Onto the chipping head, on the head end face thereof touching a wooden workpiece being processing and/or on the lateral surface of a disc-like or flange-like element such as a circular saw blade mounted on the chipping head body, there is formed at least one groove and/or ridge, the groove and/or ridge spiraling about the axis of head body rotation so that the starting point of the groove and/or ridge is radially displaced at a distance from the axis of rotation and, respectively, the end point of the groove/ridge is closer than its starting point to the axis of rotation.

14 Claims, 2 Drawing Sheets

FIG 3
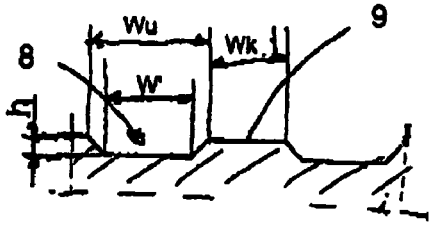
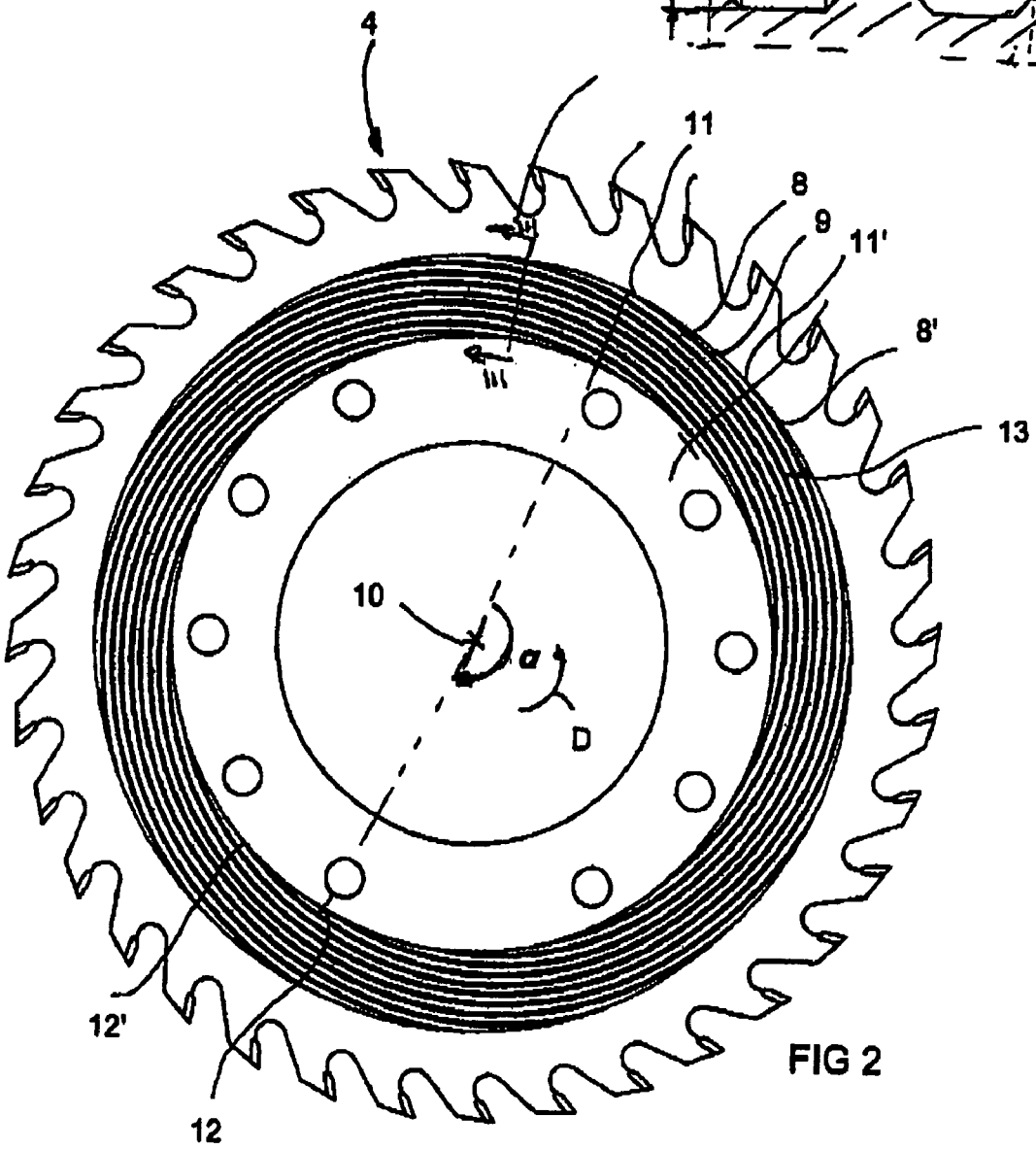
FIG 2

CHIPPING HEAD

BACKGROUND OF THE INVENTION

The present invention relates to a chipping head, particularly a chipping head of a chipping canter, according to the preamble of claim 1, comprising a head body having thereon mounted multiple chipping knives that are adapted on the head body in an annular fashion spaced at a distance from each other.

The invention also relates to a circular was blade according to the preamble of claim 7 for use on a chipping head, particularly on a chipping head of a chipping canter.

Wooden workpieces such as logs to be sawn are generally first worked on at least one side, most generally on two opposite sides, prior to taking them to rip sawing, for instance. Conventionally, this step is carried out by working certain lateral portions of the log into chips by virtue of feeding the log trunk into a gap between two rotatable chipping heads opposed to each other. Typically the opposite sides of a wooden workpiece such as a log or cant are worked and chipped in such a chipping canter into flat surfaces, whereupon the actual sawing of the log or cant takes place. From the prior art are known chipping heads of a chipping canter having, e.g., a frustroconical shape on which knife inserts are arranged, e.g., in a sequence forming a spiral, whereby working takes place so that touching the wood takes place by one insert at a time in a sequence starting from the first insert situated at the outer periphery and proceeding radially toward the inserts mounted closer to the rotating shaft of the frustroconical chipping head. In the art are also known chipping heads having the end face of the chipping head, that is, the face typically closest to the centerline of the log being worked, equipped with a saw blade, e.g., a circular saw blade or a head body peripherally carrying a plurality of separate blade tip inserts. This kind of chipping head is typical in balk slabbing machines, cant chippers and the like woodworking machines that typically have at least two chipping heads. An embodiment of such a chipping head is disclosed in U.S. Pat. No. 4,499,934. Another embodiment of chipping head is disclosed in patent publication WO 01/83175.

One typical high-capacity log sawing system equipped with a chipping canter is HewSaw R200 sawing machine manufactured by Veisto Oy, Finland. The end face of the chipping canter head situated closest to the log centerline is a so-called end-planing head that produces a precise and clean-cut face on the cant. For easier log feed and sawing of curved log, and to avoid cutting at a negative rake angle, the chipping head is generally set to rotate at a small angle in regard to the centerline of the sawing machine, i.e., in a "plowing" toe-in disposition having the wood contacted in the log feed direction only by that area of the chipping head frontal surface which is oriented toward infeed end of the machine. Due to such a plowing toe-in clearance angle of the chipping head, the log being processed may move during working in the axial direction of the chipping head thus causing unevenness and grooves on the sawn face. If the chipping head clearance angle is made smaller, friction between the chipping head and the wood increases respectively, whereby log feed becomes more difficult. From U.S. Pat. No. 3,645,308 is known a chipping head embodiment having its end face provided with annular grooves intended to reduce friction. However, the annular grooves have not performed in a desired fashion. A further shortcoming in the art is that particularly under freezing conditions, sawdust tends to adhere to the sawn surface thus complicating, among other operations, timber quality measurement and travel of sawn timber through tightly-pressing guide means adapted downstream of the chipping head.

SUMMARY OF THE INVENTION

It is an object of the present invention to provide an entirely novel type of construction capable of overcoming the problems of the prior art. The goal of the invention is achieved by virtue of forming on the end face of a chipping head or the like machining element at least one spiraling groove.

A chipping head according to the invention is principally characterized in that on the end face of a chipping head touching the wooden workpiece being processed and/or on the lateral face of a disc-like or flange-like element such as a circular saw blade mounted on the chipping head body is formed at least one groove and/or ridge, the groove and/or ridge spiraling about the axis of chipping head rotation so that the starting point of the groove and/or ridge is radially displaced at a distance from the axis of rotation and, respectively, the end point of the groove/ridge is closer than its starting point to the axis of rotation.

A circular saw blade according to the invention is principally characterized in that on the lateral face of the saw blade is formed at least one groove and/or ridge, the groove and/or ridge spiraling about the axis of saw blade rotation so that the starting point of the groove and/or ridge is radially displaced at a distance from the axis of rotation and, respectively, the end point of the groove/ridge is closer that its starting point to the axis of rotation.

The embodiment according to the invention offers multiple significant benefits. The clearance angle of a canter chipping head can be adjusted smaller, whereby the surface quality and dimensional accuracy of a wooden workpiece processed in a canter are improved without causing increased friction between the log and the chipping head end face or complications in cant travel. The embodiment according to the invention also imparts a cleaning effect on the surface of the worked cant, whereby on the sawn surface remains no sawdust that could cause problems, e.g., in auxiliary functions such as measurements. Additionally, the end face of the chipping head can be made to give better support to the wooden workpiece being processed, whereby the workpiece cannot deflect in the lateral or vertical directions. Also the longitudinal twisting of the wooden workpiece during sawing is prevented. The spiraling contouring reduces friction and eases log infeed. Sometimes in practice may occur situations in which the chipping head tends to propel the log faster than the preset feed speed of the canter line thus stressing the knives and deteriorating the chip quality. In this case the spiraling contouring eliminates jerks in log feed.

BRIEF DESCRIPTION OF DRAWINGS

In the following, the invention is described in more detail with the help of an exemplary embodiment by making reference to the appended drawings in which

FIG. 2 shows a circular saw blade forming a portion of a chipping head according to the invention in a side elevation view of the end face; and FIG. 3 shows a partially cross-sectional view taken along line III—III across the grooves and/or ridges of the circular saw blade of FIG. 2.

DETAILED DESCRIPTION OF THE INVENTION

Figure 1:
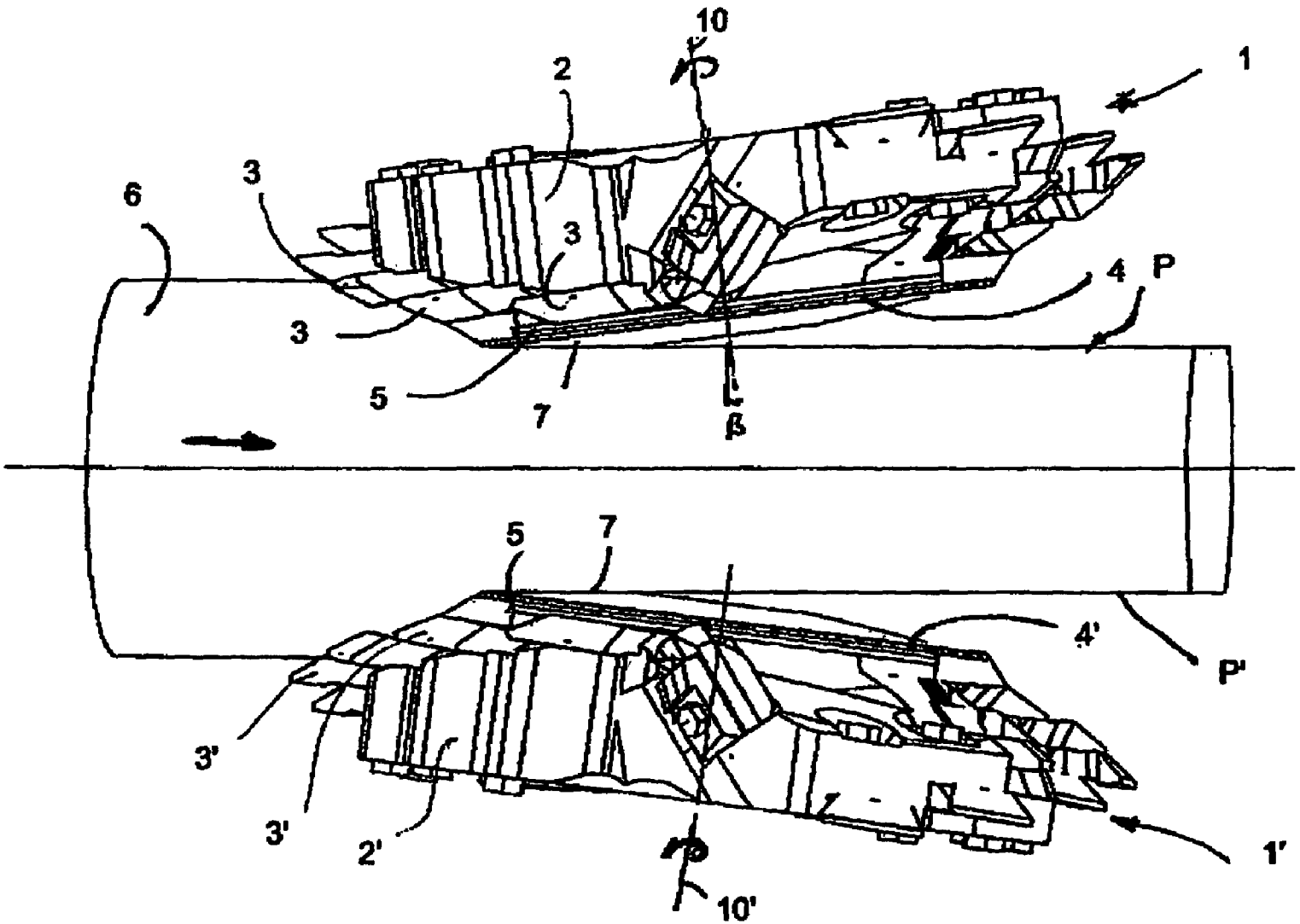
FIG. 1 shows a chipping head according to the invention adapted to a chipping canter.

Referring to FIG. 1, therein is shown a chipping head 1 according to the invention installed in a chipping canter. In the embodiment illustrated in the diagram, the number of chipping heads 1, 1' is two forming a gap through which a wooden workpiece 6 to be processed, such as a log or cant, is fed. The opposite sides of the wooden workpiece are worked and chipped by a chipping canter into flat surfaces P, P', whereupon the actual sawing of the log or cant is carried out. The chipping heads, 1, 1' are rotated on a shaft 10, 10' by a suitable drive means such as an electric motor (not shown in diagrams).

The chipping head 1, 1', particularly the chipping head of a chipping canter, comprises a head body 2, 2' having thereon adapted multiple chipping knives 3, 3' adapted on the head body circumferentially displaced at a distance from each other. Onto the chipping head 1, 1', on the head end face 5, 5' thereof touching the wooden workpiece 6 being processed and/or on the lateral surface 7, 7' of a disc-like or flange-like element such as a circular saw blade 4, 4' mounted on the chipping head body 2, 2', there is formed at least one groove 8 and/or ridge 9, the groove and/or ridge spiraling about the axis 10 of head body rotation so that the starting point 11 of the groove and/or ridge is radially displaced at a distance from the axis 10 of rotation and, respectively, the end point 12 of the groove/ridge is closer than its starting point 11 to the axis 10 of rotation.

The groove 8 and/or ridge 9 made on the chipping head wind(s) from the outer periphery toward the inner periphery, most advantageously in a direction counter to the direction D of chipping head rotation. As multiple grooves 8 and/or ridges 9 are employed, they form a multiple-ended thread. Typically, the groove and/or ridge winds about the axis 10 of chipping head rotation by an angle $\alpha$ (alpha). While the angle $\alpha$ in FIG. 2 is shown to be about 180°, it may as well be selected in a wide range from 10° to 720°, for instance. Hence, the value of angle $\alpha$ can be varied from a circular segment, to a plural number of turns.

The radial pitch of the grooves 8 and/or ridges 9 is adapted to comply with the rotating speed of the chipping head 1 and/or the disc-like or flange-like element such as a circular saw blade 4, as well as the desired infeed speed of the wooden workpiece 6 being processed. The grooves 8 and/or ridges 9 form on the circular saw blade and/or chipping head 1 a zone 13 that most advantageously has an annular shape.

The circular saw blade, particularly for the chipping head of a chipping canter, has on the lateral surface 7 of the circular saw blade 4 formed at least one groove 8 and/or ridge 9, the groove and/or ridge spiraling about the axis 10 of the circular saw rotation so that the starting point 11 of the groove and/or ridge is radially displaced at a distance from the axis 10 of the rotation and, respectively, the end point 12 of the groove/ridge is closer than its starting point 11 to the axis 10 of rotation.

The groove 8 and/or ridge 9 winds from the outer periphery toward the inner periphery in a direction counter to the direction D of the circular saw rotation. As multiple grooves 8 and/or ridges 9 are employed, they form a multiple-ended thread. The radial pitch of grooves 8 and/or ridges 9 is adapted to comply with the rotating speed of the circular saw blade, as well as the desired infeed speed of the wooden workpiece 6 being processed. The grooves 8 and/or ridges 9 form on the circular saw blade and/or chipping head 1 a zone 13 that most advantageously has an annular shape.

To make log infeed and curve-sawing easier, as well as to avoid so-called negative rake angle cutting, the chipping head is generally adapted to rotate in a position tilted from the centerline of the machine by a small angle $\beta$ thus making the chipping head to "plow" so that in the infeed direction of the log only the trailing area of the chipping head end face meets the wood. The end face of chipping head is grooved to reduce the head-to-wood mating area and, hence, the friction therebetween. The grooves are made in a spiraling fashion such that the pitch of the spiraling grooves complies with the rotating speed of the chipping head and the average or desired log infeed speed. The radial pitch of the spiraling groove may be made such that it matches the travel speed of the log or, moreover, even tending to augment the feed force imposed on the log. In one embodiment, the grooved annular zone 13 of the chipping head end face is raised outwardly from a given plane of the end face perpendicular to the axis of the chipping head rotation, e.g., from the sawing plane of the circular saw blade touching the wood surface. Typically, the zone 13 forms the lateral surface of a truncated cone or a portion thereof. Herein, the inclination angle of the truncated cone relative to the sawing plane typically corresponds to the plowing toe-in angle $\beta$ of the chipping head.

Depending on the wood species, log feed speed and chipping head rotating speed, operating conditions, etc., the spiraling contouring of the end face may be varied. FIG. 3 shows in a cross-sectional view the grooves 8 and/or ridges 9 of the circular saw blade of FIG. 2. In a typical exemplary embodiment, the depth h of the grooves is in the order of 0.3–5 mm, typically 0.5–3 mm, most advantageously 0.5–1 mm, for instance. The shape of the grooves may be varied.

To a person skilled in the art it is obvious that the invention is not limited by the above-described exemplifying embodiment, but rather may be varied within the inventive spirit and scope of the appended claims. Accordingly, the characterizing features discussed in the description part in conjunction with other characterizing features may as well be applied independently from each other when appropriate.

What is claimed is:

1. A chipping head of a chipping canter, comprising a head body having mounted thereon multiple chipping knives that are positioned on the head body in an annular fashion and are spaced at a distance from each other, wherein on a head end face thereof touching a wooden workpiece being processed, there is formed at least one groove or ridge, the groove or ridge spiraling about an axis of head body rotation so that the starting point of the groove or ridge is radially displaced at a distance from the axis of head body rotation and the end point of the groove or ridge is closer than its starting point to the axis of head body rotation.

2. The chipping head of claim 1, wherein the groove or ridge winds from the outer periphery toward the inner periphery in a direction counter to the direction of head body rotation.

3. The chipping head of claim 1, wherein the groove or ridge comprises multiple grooves or ridges forming a multiple-ended thread.

4. The chipping head of claim 1, wherein the radial pitch of the grooves or ridges is adapted to comply with the rotating speed of the chipping head, as well as the desired infeed speed of the wooden workpiece being processed.

5. A disc mounted on a surface of a chipping head of a chipping canter, wherein on a lateral face of the disc is formed at least one groove or ridge, the groove or ridge spiraling about an axis of disc rotation so that a starting point of the groove or ridge is radially displaced at a distance from the axis of rotation and, respectively, the end point of the groove or ridge is closer than its starting point to said axis of rotation.

6. The disc of claim 5, wherein the grooves or ridges wind from the outer periphery toward the inner periphery, in a direction counter to a direction of chipping head body rotation.

7. The disc of claim 5, wherein the groove or ridge comprises multiple grooves or ridges forming a multiple-ended thread.

8. The disc of claim 5, wherein a radial pitch of the grooves or ridges is adapted to comply with a rotating speed of the disc, as well as a desired infeed speed of the wooden workpiece being processed.

9. The disc of claim 5, wherein the grooves or ridges form a zone that has an annular shape.

10. The disc of claim 9, wherein the annular zone is raised outwardly, forming the lateral surface of a truncated cone or a portion thereof, from a given plane perpendicular to the axis of the disc rotation.

11. A chipping head of a chipping canter, comprising a head body having mounted thereon multiple chipping knives that are positioned on the head body in an annular fashion and are spaced at a distance from each other, wherein on a lateral surface of a circular saw blade mounted on the chipping head body, there is formed at least one groove or ridge, the groove or ridge spiraling about an axis of head body rotation so that the starting point of the groove or ridge is radially displaced at a distance from the axis of head body rotation and the end point of the groove or ridge is closer than its starting point to the axis of head body rotation.

12. The chipping head of claim 11, wherein the grooves or ridges form on the circular saw blade a zone having an annular shape.

13. The chipping head of claim 12, wherein the annular zone is raised outwardly, forming a lateral surface of a truncated cone or a portion thereof, from a given plane perpendicular to the axis of chipping head body rotation.

14. A circular saw blade, particularly for use on a chipping head of a chipping canter, wherein on a lateral face of the circular saw blade is formed at least one groove or ridge, the groove or ridge spiraling about an axis of saw blade rotation so that a starting point of the groove or ridge is radially displaced at a distance from the axis of rotation and, respectively, the end point of the groove or ridge is closer than its starting point to said axis of rotation, wherein the grooves or ridges form a zone that has an annular shape, and wherein the annular zone is raised outwardly, forming the lateral surface of a truncated cone or a portion thereof, from a given plane perpendicular to the axis of the circular saw blade rotation.

* * * * *